US005956762A

United States Patent [19]

Adams

[11] Patent Number: 5,956,762

[45] Date of Patent: Sep. 28, 1999

[54] NURSING AND/OR BURPING BLANKET

[76] Inventor: Luana C. Adams, 43905 Rockrose Ct., Palm Desert, Calif. 92211

[21] Appl. No.: 09/089,939

[22] Filed: Jun. 4, 1998

[51] Int. Cl.[6] ..... A41B 1/00

[52] U.S. Cl. ..... 2/48; 2/104

[58] Field of Search ..... 2/46, 48, 50–52, 2/69, 88, 104, 49.1

[56] References Cited

U.S. PATENT DOCUMENTS

| | | | |
|---|---|---|---|
| 2,417,888 | 3/1947 | Schuster | 2/104 |
| 3,611,439 | 10/1971 | Meyers | 2/104 |
| 4,651,349 | 3/1987 | Heiler | 2/104 |
| 4,712,251 | 12/1987 | Cobble | 2/49.1 |
| 4,964,172 | 10/1990 | Bollard . | |
| 4,987,612 | 1/1991 | Middleton . | |
| 5,034,999 | 7/1991 | Lubbers . | |
| 5,038,411 | 8/1991 | St. Armand . | |
| 5,042,090 | 8/1991 | Cook . | |
| 5,090,059 | 2/1992 | Kahl | 2/104 |
| 5,220,692 | 6/1993 | Cox | 2/48 |
| 5,479,662 | 1/1996 | Runco . | |
| 5,570,474 | 11/1996 | Berry et al. . | |

*Primary Examiner*—Gloria Hale
*Attorney, Agent, or Firm*—Venable; Michael A. Sartori

[57] ABSTRACT

A nursing and/or burping blanket comprises a fabric panel, to which a bib and two straps are removably attached. The nursing and/or burping blanket is secured to a mother by tying the two straps around the mother's neck. During nursing, the bib is folded behind the fabric panel, and during burping, the bib is placed over the mother's shoulder.

13 Claims, 3 Drawing Sheets

NURSING AND/OR BURPING BLANKET

FIELD OF THE INVENTION

My invention relates generally to a blanket for use in nursing and/or burping an infant by a mother. For convenience, the term "mother" is used throughout the specification and claims to refer to any person who nurses and/or burps the infant.

BACKGROUND OF THE INVENTION

A mother of a newborn infant is frequently faced with the problem of feeding her infant in a public area, while simultaneously avoiding exposing herself. Additionally, after the infant is finished nursing, the mother must further keep the infant warm and burp the infant.

Prior apparatuses have attempted to assist the mother in her nursing. Some of these include: U.S. Pat. No. 4,964,172 to Bollard; U.S. Pat. No. 4,987,612 to Middleton; U.S. Pat. No. 5,034,999 to Lubbers; U.S. Pat. No. 5,038,411 to St. Armand; U.S. Pat. No. 5,042,090 to Cook; U.S. Pat. No. 5,479,662 to Runco; and U.S. Pat. No. 5,570,474 to Berry et al.

All of these prior art devices are of some assistance to the mother while nursing the infant in public, but are of no assistance to the mother when the infant must be burped. If the infant is burped while wrapped in any of these prior art devices, the infant will most likely soil the prior art device. The soiled prior art device will then need to be washed and dried before it can be used again to assist the mother in nursing the infant.

SUMMARY OF THE INVENTION

An object of my invention is to provide a device for covering a mother during nursing to afford her sufficient privacy and/or to provide a bib for the mother's shoulder during burping to prevent soiling of the covering and the mother's shoulder.

A further object is to provide a device with a removably attachable bib that can be easily removed if soiled by the infant during burping.

A still further object is to provide a device with removably attachable straps for hanging the device around the mother's neck.

Another object is to provide a device that allows the mother to wrap the infant in a warm blanket while the infant is being burped.

Additional objects of my invention are to provide:

- A device that will remain in place while the infant is nursing;
- A device that does not need to be rearranged if the infant is switched from one side of the mother to the other during nursing;
- A device that is simple in construction, inexpensive, lightweight, and flexible enough to be folded or rolled into a small size to be placed into a purse or a knapsack;
- A device that can be quickly and easily attached around the mother;
- A device that can be worn around the mother's neck, and permits the mother to nurse the infant and burp the infant without removing the device from the mother's neck
- A device with a removably attachable bib and removably attachable straps that functions as a wrap for an infant when the bib and straps are removed; and

- A device comprising a fabric panel and a plurality of bibs, each of which can be removably attached to the fabric panel in at least one location and each of which can replace a previously attached soiled bib.

Accordingly, my invention includes a blanket comprising a fabric panel for covering the infant during nursing, and a bib removably attached to the fabric panel for covering a shoulder of the mother during nursing and burping an infant. The blanket further comprises two straps removably attached to the fabric panel for hanging the blanket from the mother's neck. Further, the bib can be removably attached to two locations of the fabric panel, each location corresponding to one of the mother's shoulders. The bib and straps are removably attached to the fabric panel using fasteners, such as interlocking snaps.

BRIEF DESCRIPTION OF THE DRAWINGS

The embodiments of my invention are explained in greater detail by way of the drawings, where similar reference numerals refer to the same component of my invention.

DETAILED DESCRIPTION OF THE PREFERRED EMBODIMENTS

Figure 1A:
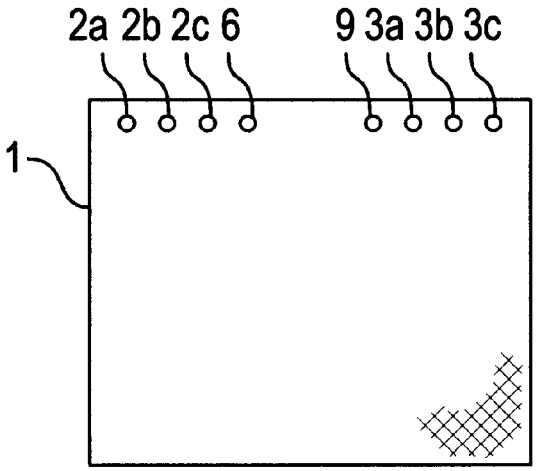
FIGS. 1A–1D illustrate the four basic components of the nursing blanket: a fabric panel illustrated in FIG. 1A; a bib illustrated in FIG. 1B; a first strap illustrated in FIG. 1C; and a second strap illustrated in FIG. 1D.
Figure 1B:
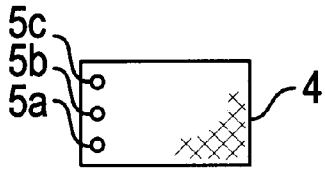
Figure 1C:
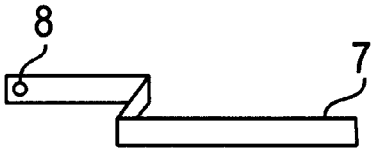
Figure 1D:
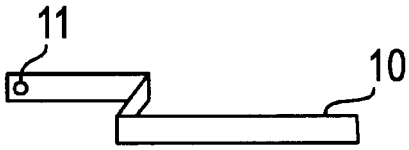

In FIGS. 1A–1D, the four principal components of my invention are illustrated. In particular, a fabric panel 1 is illustrated in FIG. 1A, a bib 4 is illustrated in FIG. 1B, a first strap 7 is illustrated in FIG. 1C, and a second strap 10 is illustrated in FIG. 1D. The fabric panel 1 is of a sufficient size to cover the infant during nursing and to prevent the mother from being exposed during nursing. The fabric panel 1 is preferably made of a soft, flexible cloth, and is preferably rectangular in shape. Alternatively, the fabric panel 1 can be of any size and shape such that the infant and the mother are sufficiently covered during nursing.

The bib 4 is of sufficient size to cover a shoulder of the mother during burping of the infant. The bib 4 is preferably made of a soft, flexible cloth similar to that used to make the fabric panel 1. Further, the bib 4 is preferably rectangular in shape, although any shape useful for the purpose of covering the shoulder of the mother can be used.

The straps 7 and 10 are used for securing the fabric panel 1 around the neck of the mother. Straps 7 and 10 are preferably made from a soft, flexible cloth similar to that used to make the fabric panel 1.

Figure 1E:
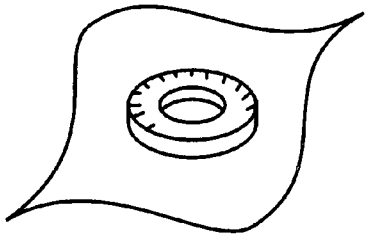
FIG. 1E illustrates a female part of an interlocking snap.

The bib 4 and the straps 7 and 10 are removably attachable to the fabric panel 1. Along one side of the fabric panel 1, a row of eight female parts 2*a*, 2*b*, 2*c*, 6, 9, 3*a*, 3*b*, and 3*c* of eight metal or plastic interlocking snaps are aligned and are attached to the fabric panel 1. FIG. 1E illustrates a female part of an interlocking snap. Female parts 2*a*, 2*b*, and 2*c* form a first set of fasteners for removably attaching the bib 4 to one side of the fabric panel 1 corresponding to one shoulder of the mother. Female parts 3*a*, 3*b*, and 3*c* form a second set of fasteners for removably attaching the bib 4 to the opposite side of the fabric panel 1 corresponding to the other shoulder of the mother. Female parts 6 and 9, which are located between the first and second set of fasteners, are for removably attaching the straps 7 and 10 to the fabric panel 1.

Figure 1F:
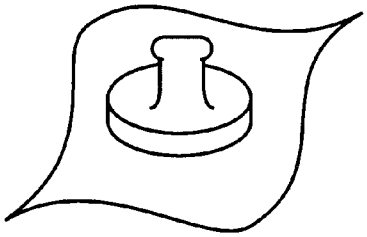
FIG. 1F illustrates a male part of an interlocking snap.

Along one side of the bib 4, three male parts 5*a*, 5*b*, and 5*c* of three metal or plastic interlocking snaps are aligned in a row and are attached to the bib 4. FIG. 1F illustrates a male part of an interlocking snap.

The three male parts 5*a*, 5*b*, and 5*c* of the bib 4 are used to removably attach the bib 4 to one side of the fabric panel 1 using the first set of female parts 2*a*, 2*b*, and 2*c*. In particular, the bib 4 is removably attached to the fabric panel 1 by snapping together male part 5*a* with female part 2*a*, snapping together male part 5*b* with female part 2*b*, and snapping together male part 5*c* with female part 2*c*. When these six parts are snapped together in this way, three interlocking snaps are formed. The bib 4 is removed from the fabric panel 1 by unsnapping the three interlocking snaps.

Figure 2:
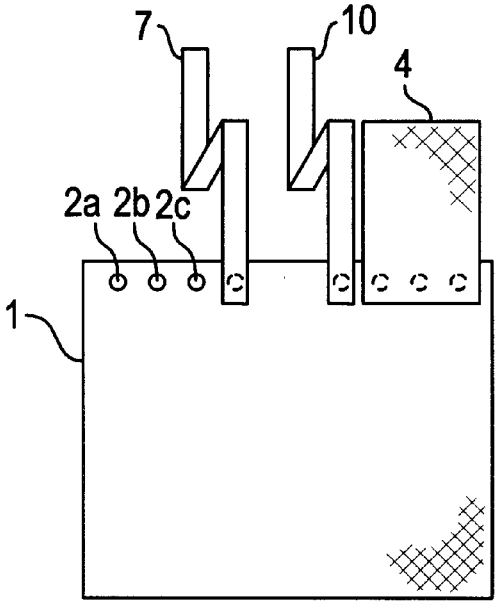
FIG. 2 is a back view of the nursing blanket when all of the components are attached together.

Alternatively, and as shown in FIG. 2, the bib 4 can be removably attached to the other side of the fabric panel 1 using male parts 5*a*, 5*b*, and 5*c* of the bib 4 and the second set of female parts 3*a*, 3*b*, and 3*c* of the fabric panel 1. In particular, male part 5*a* is snapped together with female part 3*a*, male part 5*b* is snapped together with female part 3*b*, and male part 5*c* is snapped together with female part 3*c*. When these six parts are snapped together in this way, three interlocking snaps are formed when the bib 4 is attached to the fabric panel 1. The bib 4 is removed from the fabric panel 1 by unsnapping the three interlocking snaps.

The straps 7 and 10 are removably attachable to the fabric panel 1 using interlocking snaps. To one end of the strip 7, a male part 8 of an interlocking snap is attached, and to one end of the strap 10, a male part 11 is attached. The strap 7 is removably attached to the fabric panel 1 by snapping together the male part 8 with the female part 6 of the fabric panel 1, and the strap 10 is removably attached to the fabric panel 1 by snapping together the male part 11 with the female part 9 of the fabric panel 1. When the straps 7 and 10 are secured to the fabric panel 1, two interlocking snaps are formed. The straps 7 and 10 are removed from the fabric panel 1 by unsnapping the two interlocking snaps.

Because the two straps 7 and 10 are removably attachable to the fabric panel 1, these straps can be removed so that the fabric panel 1 can be used by itself as a nursing blanket. Alternatively, the straps 7 and 10 can be permanently secured to the fabric panel 1.

As will be apparent to one of ordinary skill in the art, the number of interlocking snap parts attached the fabric panel 1 and the bib 4 can be modified. For example, one, two, three, four, five, etc. male parts can be attached to the bib 4, the same number of female parts can be attached to one side of the fabric panel 1, and the same number of female parts can be attached to the other side of the fabric panel 1.

Instead of using female parts with the fabric panel 1 and male parts with the bib 4 and straps 7 and 10, male parts can be used with the fabric panel 1, and female parts can be used with the bib 4 and straps 7 and 10.

Instead of using male and female parts to form interlocking snaps, the bib 4 and the straps 7 and 10 can be removably attached to the fabric panel 1 using other techniques. For example, buttons and button holes, hooks and eyes, hook and loop fasteners, commonly known as VELCRO®, and similar devices for removably attaching one piece of material to another can be used.

Figure 3:
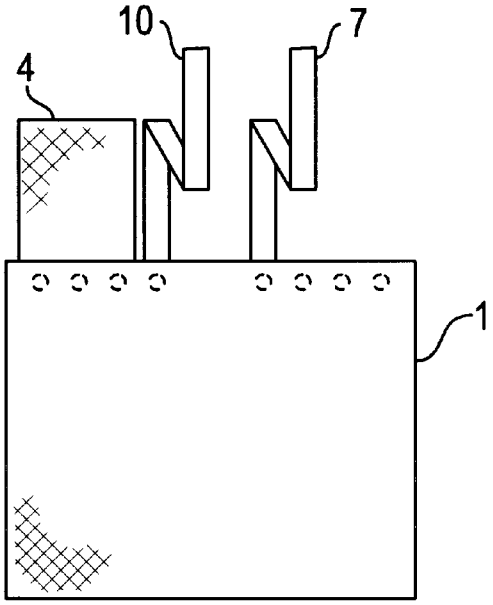
FIG. 3 is a front view of the nursing blanket when all of the components are attached together.

In FIGS. 2 and 3, the four components of the nursing blanket are shown attached. FIG. 2 illustrates the back of the nursing blanket, and FIG. 3 illustrates the front of the nursing blanket.

Figure 4:
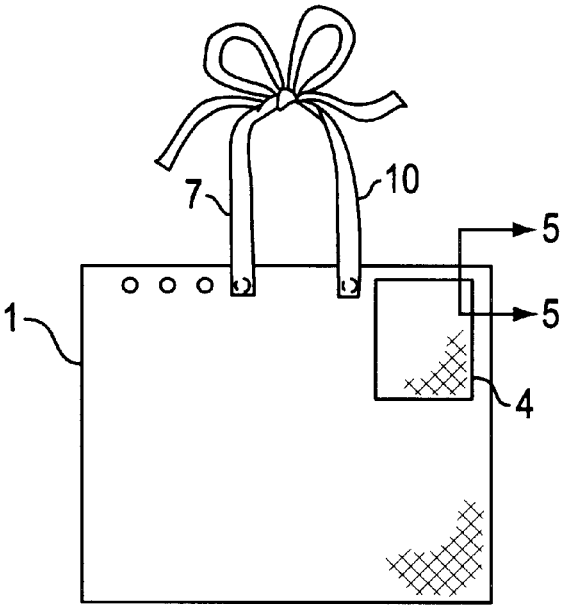
FIG. 4 is a back view of the nursing blanket where the removably attachable straps are tied together and the removably attachable bib is folded down.
Figure 5:
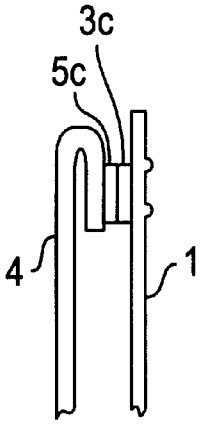
FIG. 5 is a side view of the nursing blanket along line 5—5 of FIG. 4.

FIG. 4 illustrates the nursing blanket ready for use by the mother. The straps 7 and 10 are tied together to form a bow knot. The bib 4 is folded behind the fabric panel 1, as shown in the cutaway illustrated in FIG. 5.

In an alternative embodiment, the nursing blanket can be secured to the mother's neck using other techniques besides tying the two straps together. For example, the two straps 7 and 10 can be attached to one another by using a belt buckle, a button and button holes, a hook and eyes, a hook and loop fastener, or a similar device for removably attaching two straps to one another.

As another example for securing the nursing blanket to the mother's neck, one strap, instead of two straps, can be used. With a single strap, a first male part of an interlocking snap is attached to one end of the single strap, and a second male part of an interlocking snap is attached to the other end the single strap. The single strap is removably attached to the fabric panel 1 by snapping together the first male part of the single strap with the female part 6 of the fabric panel 1, and by snapping together the second male part of the single strap with the female part 9 of the fabric panel 1. Further, the single strap can include a D-ring or similar device for adjusting the length of the single strap.

Figure 6:
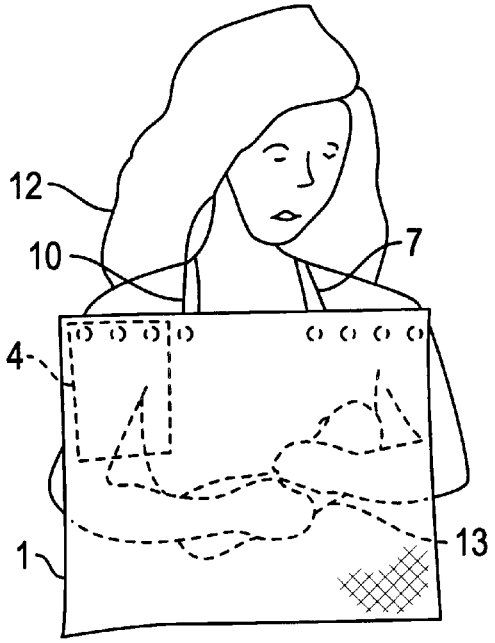
FIG. 6 is a pictorial view showing the blanket hanging from the mother's neck and in use by the mother. The bib is folded behind the blanket.

FIG. 6 illustrates the nursing blanket in use during nursing. As can be seen, the fabric panel 1 is of sufficient size both to cover the infant 13 and to prevent the mother 12 from being exposed. During nursing, the mother 12 can lift a corner of the fabric panel 1 to check on the infant 13. Further, during nursing, the bib 4 is preferably folded behind the fabric panel 1.

Figure 7:
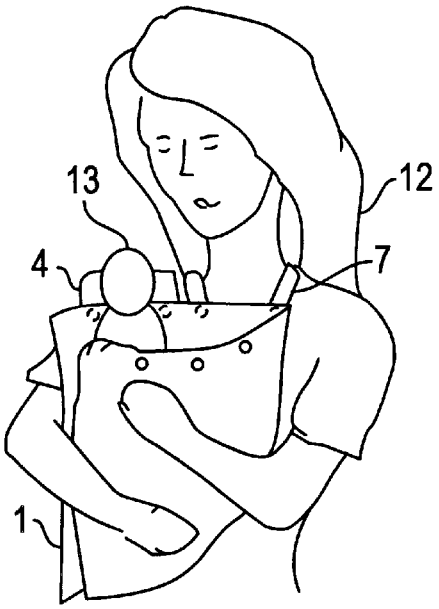
FIG. 7 is a pictorial view showing the nursing blanket in use by the mother during burping. The bib is placed over the shoulder of the mother to prevent the infant from soiling the mother's shoulder or the nursing blanet.

FIG. 7 illustrates the mother 12 using the nursing blanket while burping the infant 13. The bib 4 is placed over the shoulder of the mother, and the blanket is used to wrap around the infant 13 for warmth. When the infant is finished burping, and if the bib 4 has been soiled, the bib 4 can be easily removed by unsnapping it from the fabric panel 1. The bib 4 can then be washed and dried separately from the fabric panel 1. Another bib of the same construction as the bib 4 can be removably attached to the fabric panel 1 while the bib 4 is being washed and dried.

In another embodiment, two bibs can be removably attached to the fabric panel 1, one to the first set of female parts 2*a*, 2*b*, and 2*c*, and the other to the second set of female parts 3*a*, 3*b*, and 3*c*. With this embodiment, the infant 13 can be burped over either shoulder of the mother 12 without needing to move the bib 4 to the desired shoulder.

When not being used for nursing or burping an infant, the bib 4 and straps 7 and 10 can be removed from the fabric panel 1, and the fabric panel 1 can be used by itself as a blanket or a wrap for the infant.

As will be apparent to one of ordinary skill, if the infant is being bottle fed and not nursed, my invention can function as a covering for the mother's shoulder during burping and as a wrap for the infant.

My invention has been described in detail with respect to preferred embodiments, and it will now be apparent from the foregoing to those skilled in the art that changes and modifications may be made without departing from my invention in its broader aspects, and my invention, therefore, as defined in the appended claims, is intended to cover all such changes and modifications as fall within the true spirit of my invention.

What is claimed is:

1. A blanket for use in nursing and/or burping an infant by a mother, the blanket comprising:

a fabric panel for covering the infant during nursing;

a bib removably attached to the fabric panel and for covering a shoulder of the mother during burping; and a first strap attached to the fabric panel for hanging the blanket from a neck of the mother.

2. The blanket of claim 1, wherein a side of the fabric panel is provided with at least one fastening device, said bib being removably attached to the fabric panel by said at least one fastening device.

3. The blanket of claim 1, wherein a side of the fabric panel is provided with at least one part of an interlocking snap, and wherein a side of the bib is provided with at least one part of an interlocking snap for snapping to the at least one interlocking snap of the fabric panel for removably attaching the bib to the fabric panel.

4. The blanket of claim 1, further comprising means for removably attaching the bib to the fabric panel.

5. The blanket of claim 1, wherein the bib is removably attachable to a first location of the fabric panel for covering a first shoulder of the mother and removably attachable to a second location of the fabric panel for covering a second shoulder of the mother.

6. The blanket of claim 1, wherein the fabric panel comprises a side having first and second fasteners, wherein the bib comprises a side having a third fastener, the bib being removably attached to the fabric panel using the first and third fasteners or using the second and third fasteners.

7. The blanket of claim 1, wherein the first strap is removably attached to the fabric panel.

8. The blanket of claim 1, further comprising a second strap attached to the fabric panel for use with the first strap for hanging the blanket from the neck of the mother.

9. The blanket of claim 1, wherein the bib comprises a pliable material such that the bib is foldable between the fabric panel and the mother during nursing and unfoldable over the shoulder of the mother during burping.

10. An infant caretaker kit comprising:

a blanket for covering an infant during feeding;

a bib for covering a shoulder of a mother after the infant is finished feeding, the bib being removably attachable to the blanket; and a first strap for hanging the blanket from a neck of the mother, the first strap being removably attachable to the blanket.

11. A blanket for use in nursing and/or burping an infant by a mother, the blanket comprising:

a fabric panel for covering the infant during nursing, said fabric panel being generally rectangular in shape and having a side;

six fasteners attached in a row on the side of said fabric panel, the six fasteners being arranged to form a first set of three fasteners and a second set of three fasteners;

a bib for covering a shoulder of the mother during burping, said bib being generally rectangular in shape and having a side;

three fasteners attached in a row on the side of said bib for removably attaching said bib to said fabric panel by removably attaching the three fasteners attached to said bib to the first set of three fasteners of said fabric panel or to the second set of three fasteners of said fabric panel;

two additional fasteners attached to the side of said fabric panel aligned in the row on the side of said fabric panel, the row on the side of said fabric panel comprising an ordered row of the first set of three fasteners, the two additional fasteners, and the second set of three fasteners;

a first strap having an end;

a first additional fastener attached to the end of said first strap for removably attaching the first strap to said fabric panel by removably attaching the first additional fastener to one of the additional fasteners of said fabric panel;

a second strap having an end; and a second additional fastener attached to the end of said second strap for removably attaching the second strap to said fabric panel by removably attaching the second additional fastener to one of the additional fasteners of said fabric panel.

12. The blanket of claim 11, wherein the three fasteners of said bib attached to one of the sets of three fasteners of said fabric panel form three interlocking snaps.

13. The kit of claim 10, further comprising a second strap for hanging the blanket from the neck of the mother, the second strap being removably attachable to the fabric panel for use with the first strap.

* * * * *